United States Patent [19]

Wigoda

[11] Patent Number: 4,698,150

[45] Date of Patent: Oct. 6, 1987

[54] BEACH TRASH MACHINE

[76] Inventor: Luis Wigoda, 841 Washington Ave., Miami Beach, Fla. 33139

[21] Appl. No.: 778,395

[22] Filed: Sep. 20, 1985

[51] Int. Cl.[4] ..... B07B 1/00; B07B 1/28; E02F 3/00; E02F 3/76

[52] U.S. Cl. ..... 209/421; 209/259; 209/260; 209/275; 209/405; 37/4; 37/117.5; 37/118 A; 171/71; 171/105; 172/701.1; 172/811; 414/551; 414/722

[58] Field of Search ..... 209/421, 420, 418, 419, 209/259, 260, 275, 405; 37/4, 117.5, 118 A, 142.5; 172/701.1, 701.2, 701.3, 811, 817; 171/104, 105, 71; 414/551, 552, 553, 554, 555, 722, 724, 725

[56] References Cited

U.S. PATENT DOCUMENTS

| | | | |
|---|---|---|---|
| 1,301,643 | 4/1919 | Blank | 414/551 |
| 2,441,591 | 5/1948 | Owen | 414/551 |
| 2,525,384 | 10/1950 | Troutman | 414/551 X |
| 2,824,655 | 2/1958 | Harbers | 414/551 X |
| 3,072,257 | 1/1963 | Hockenberry | 37/117.5 X |
| 3,112,573 | 12/1963 | Moras | 172/817 X |
| 3,142,341 | 7/1964 | De Biasi | 209/421 X |
| 3,362,480 | 1/1968 | Barber | 171/89 |
| 3,395,798 | 8/1968 | Erickson | 209/421 X |
| 3,458,069 | 7/1969 | Wickberg | 414/722 |
| 3,461,968 | 8/1969 | Longley | 209/421 |
| 3,477,573 | 11/1969 | Anderson | 209/421 X |
| 3,732,980 | 5/1973 | Evers et al. | 209/421 |
| 3,765,490 | 10/1973 | Logue | 171/132 |
| 3,979,146 | 9/1976 | Berg | 209/418 |
| 4,157,956 | 6/1979 | Robinson | 209/421 X |
| 4,197,194 | 4/1980 | Read | 209/421 X |
| 4,242,035 | 12/1980 | Hornstein | 414/724 |
| 4,422,819 | 12/1983 | Guest | 37/117.5 |

FOREIGN PATENT DOCUMENTS

| | | | |
|---|---|---|---|
| 1282554 | 11/1968 | Fed. Rep. of Germany | 414/722 |
| 2741942 | 3/1979 | Fed. Rep. of Germany | 209/421 |
| 2265464 | 3/1974 | France | 209/421 |
| 2412663 | 8/1979 | France | 209/421 |
| 1291555 | 12/1970 | United Kingdom | 209/421 |

*Primary Examiner*—S. Leon Bashore
*Assistant Examiner*—Thomas M. Lithgow
*Attorney, Agent, or Firm*—Harry W. Barron

[57] ABSTRACT

There is disclosed herein a beach trash remover which includes a motorized vehicle having a conventional construction type shovel attached to the front thereof. An opening covered by a screen is provided in the center of shovel to allow the beach sand, containing the trash, to drop back onto the beach thereby leaving the trash within the screened opening portion of the shovel. The screen is held on a frame which is coupled to the shovel through shock absorbers and means are provided to provide a vibrating motion to the screened frame to further aid in returning the sand to the beach. A grader may be attached to the back end of the beach trash remover to cover any tire tracks or otherwise smooth the beach.

13 Claims, 6 Drawing Figures

BEACH TRASH MACHINE

This invention relates to a machine for removing trash from a beach, and more particularly to such a machine having a shovel with a moving screened cut-out for allowing the sand to be returned to the beach and the trash to be trapped in the screened area.

As the sun sets in the horizon after a warm, sunny day, and people leave the beach to return to their homes, there remains on the sand a tremendous amount of trash and litter left by the beachgoers. This trash may include things like soft drink cans and bottles, paper, and articles inadvertently left behind by the public. In order to maintain the beauty and cleanliness of the beaches, it is desirable, if not necessary, that this trash be removed prior to the next day's beach crowds. Traditionally this has been done by individual workmen walking along the beach and picking up trash, either by hand or by using various handheld devices. A truck, or other mechanised vehicle, generally moves along with the workers picking up the trash to allow the trash to be deposited into a large container on the vehicle.

It would be desirable if the vehicle itself accompanying the individuals picking up the trash could accomplish the clean-up task. This would eliminate much of the manual labor and associated costs required to clean the beach, as well as speed up the process. In the past, devices such as bulldozers or tractors having shovels attached thereto have been used to scoop off the upper layer of sand and trap much of the trash in the shovel. As the trash is transferred to a container, there also is transferred with the trash a considerable amount of beach sand. The result is that the sand is taken away from the beach and the trash container itself becomes filled more quickly. In order to overcome this problem, one could build within the shovel portion of the motorized vehicle a screen which would have a mesh sufficiently coarse to allow the sand grains to fall therethrough and return to the beach but sufficiently fine to trap the trash desired. A screened device of this type would operate more efficiently in loosening sand stuck to the trash if the screen could be made to vibrate. Such a vibrating screened mechanism could then be used to quickly eliminate the trash from the sand and fill the container with only trash and leave the sand on the beach where it belongs.

In the prior art, people have suggested using screens to separate different substances for many years. For example, in U.S. Pat. No. 3,834,534 to Peterson et al. it is suggested that a vibratory screen can be used for screening different sized particles. Further, screens have been attached to mechanized equipment such as shown in U.S. Pat. No. 2,831,565 to Hensley, which relates to an agricultural tractor having a conveyor used for stripping cotton from a plant. Screens are used to separate the cotton from rocks which also end up on the conveyor belt. None of the prior art, however, suggests solving the problem in a manner which would be useful to clean a beach.

In accordance with one aspect of this invention, there is provided a machine for removing trash from a sandy beach comprising motorized means for moving along the beach and including a container and shovel means attached to the motorized means for picking up trash from the beach. The shovel means includes a movable screen means for separating sand from the trash and returning the sand to the beach. In addition, the machine includes means for transferring the trash remaining in the shovel means to the container.

One preferred embodiment of the subject invention is hereafter described with specific reference being made to the following Figures, in which.

Figure 1:
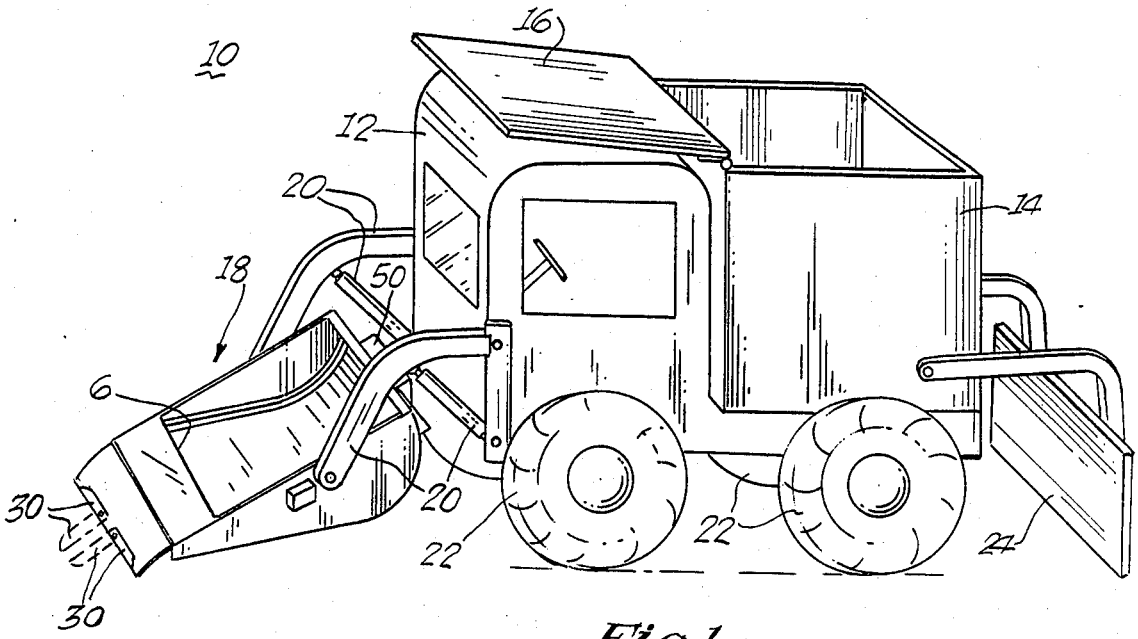
FIG. 1 shows the beach trash removing machine of the subject invention.

Referring to FIG. 1, beach trash remover 10 is shown and includes a motorized vehicle 12 having a conventional trash container 14 positioned thereon. Trash container 14 may be any conventional commerical trash container which may be easily removed from the trailer bed of vehicle 12 so that the trash container therein may be emptied. A chute 16 is provided over the cab of vehicle 12 to allow trash placed on the chute to be guided into container 14. Chute 16 may be the top of trash container 14 and can be held in an angular position to allow the trash placed theron to fall by gravitational forces into container 14.

Coupled to the front end of vehicle 12 is a shovel 18. Shovel 18 may be similar in shape to a conventional shovel found on construction equipment used to move dirt from one area to another. Shovel 18 is connected to vehicle 12 by conventional connecting members 20 which allow shovel 18 to be tilted and raised and lowered in the normal manner. Typically, connecting members 20 will include hydraulic means for controlling the positioning of shovel 18 in the sand as well as the raising of shovel 18 over the top of the cab of vehicle 12 so that the contents within shovel 18 may be emptied onto chute 16 for transfer into container 14.

Vehicle 12 is of the type which can be easily operated over a sandy beach. Thus vehicle 12 includes four large tires 22, designed to easily move over sand. Because the tires 22 leave tracks in the sand, a blade 24 is provided at the back end of vehicle 12 to grade the beach area and thereby remove the tire tracks left by tires 22. Further continued usage of blade 24 will result in the beach being maintained level.

Shovel 24 is normally positioned just below the sand surface as to scoop up a slight amount of sand as vehicle 12 moves along the beach. By scooping up a slight amount of sand, any trash laying on top of the beach is correspondingly moved into shovel 18. Quite clearly, it is not desirable to dispose of the beach itself when trying to remove the trash. In order to allow the sand to be returned to the beach, an opening 26 is placed in shovel 18. Beneath opening 26 is placed a screened frame 28. The screening in frame 28 is sufficiently coarse so that the sand, which is scooped into shovel 18, may easily flow therethrough and back to the beach. However, the screen is sufficiently fine to trap the trash within the area above screened frame 28. For example, a one inch square means screen may be used. The details of opening 26 and screen frame 28 will be described hereafter.

In addition, a pair of forks 30 are included on the front edge of shovel 18. Forks 30 are designed so that they may be rotated outward to the position shown in the dashed lines and used to lift trash containers on the beach. In so doing, the trash the public has left in containers may be placed into container 14 engaging the beach container with forks 30, lifting the beach container up to chute 16 and tipping the beach container to empty the contents thereof onto chute 16. Though forks 30 have been shown as rotating outward, they also may be slidable outward or manually attachable if so desired.

Figure 4:
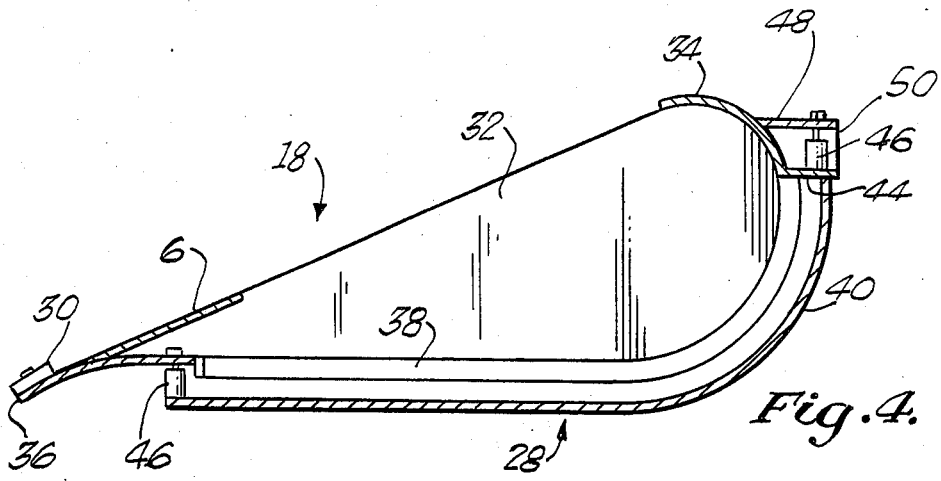
FIG. 4 shows a view taken through the center of the shovel shown in FIG. 1.
Figure 2:
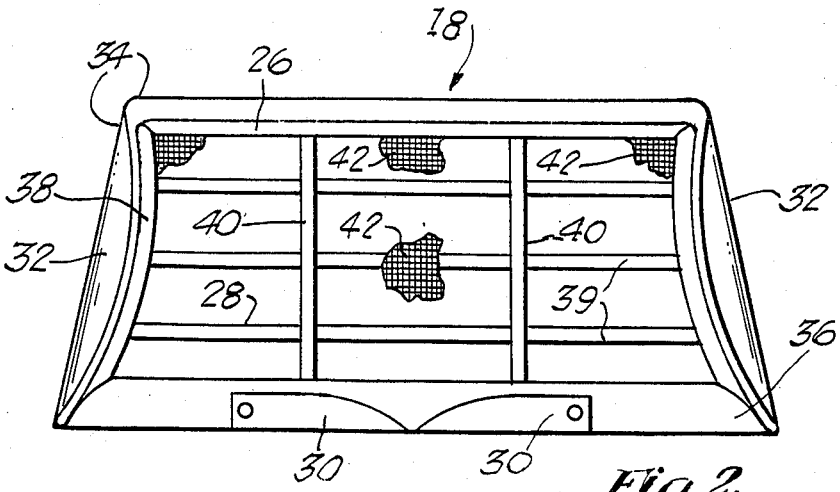
FIG. 2 shows a front perspective view of the shovel of the machine shown in FIG. 1.
Figure 3:
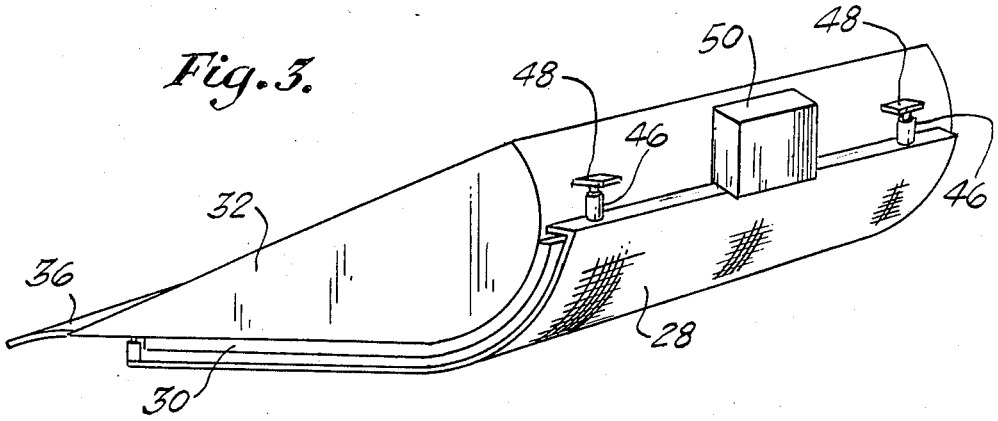
FIG. 3 shows a back perspective view of the shovel of the machine shown in FIG. 1.

Referring now to FIGS. 2 through 4, a more detailed description of shovel 18 will be given. Shovel 18 includes a pair of side panels 32 which maintain the sand and trash within the confines of the shovel area. Generally the back end 34 of shovel 18 is in the shape of a C, while the front end 36 is generally flat. The front edge of front end 36 may slant slightly downward and to a point in order to scoop up the sand and trash from the beach. From an area slightly back from front end 36 and up to approximately the vertical portion of the C-shape of back end 34, the opening 26 is provided in shovel 18. Opening 26 is slightly less than the distance separating the two side panels 32; it is only necessary that sufficient support must be provided in shovel 18 between the edge of opening 26 and the side panels 32 so that the necessary strength still exists within shovel 18. Extending downward from the two sides and front edges of opening 26 are panels 38. Screened frame 28 is attached to the bottom of shovel 18 to be just below the panels 38, as best seen in FIG. 4. Thus as the sand and trash falls into opening 26, it cannot escape through the sides because of the presence of panels 38.

Figure 5:
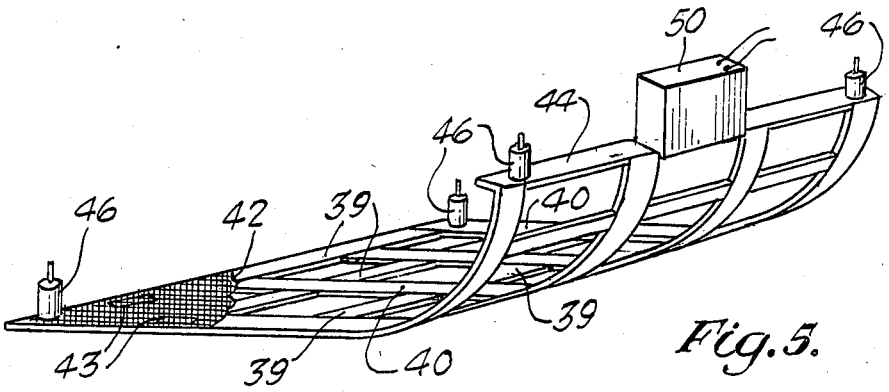
FIG. 5 shows a back perspective view of the frame of the screen for the shovel shown in FIG. 1.
Figure 6:
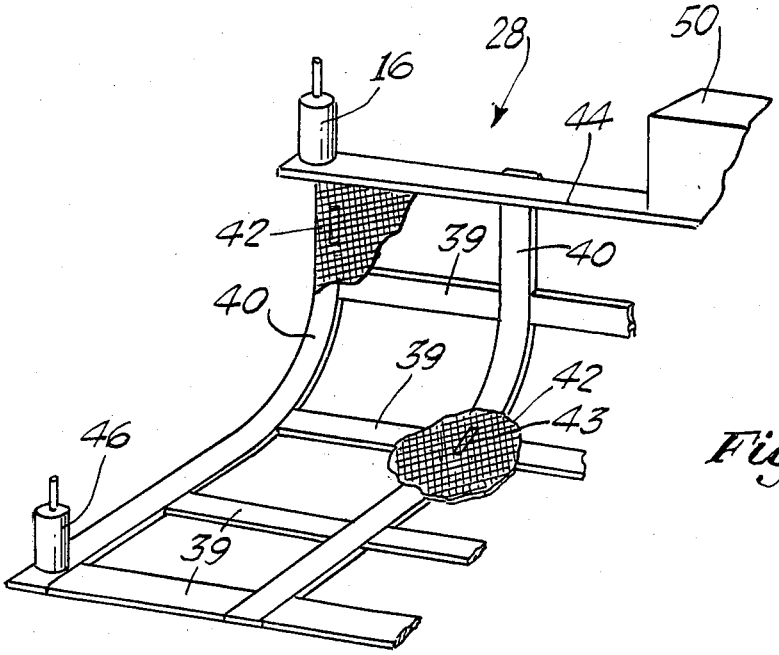
FIG. 6 shows a front perspective view of a part of the frame of the screen for the shovel shown in FIG. 1.

Referring now to FIGS. 4, 5 and 6, the manner in which screened frame 28 is attached to shovel 18 will now be described. Frame 28 includes a plurality of horizontal supports 39 and vertical supports 40, which may be welded or bolted together to form frame 28. The vertical supports 40 are shaped generally in conformity with the shape of shovel 18 beneath the opening 26. Screen 42 may be secured to frame 28 by fasteners 43. An upper support 44 is provided to be positioned generally vertical to shovel 18 at or near the back edge of opening 26. Thus support 44 functions in the same manner as panels 38 to keep the sand and trash within the confines of opening 26.

Frame 28 may be connected beneath opening 26 of shovel 18 as best seen in FIGS. 3 and 4. The manner of connecting the frame 28 is through the use of four shock absorbers 46 positioned in the four corners of frame 28. Two of the shock absorbers 46 are positioned at the corners of upper support 44 and the other two shock absorbers are positioned at the opposite corners of frame 28. The two shock absorbers 46, coupled from upper support 44, are connected to mounting brackets 48, extending from the back of shovel 18. The other two shock absorbers 46 are connected directly to the bottom of shovel 18.

In order to best separate and eliminate the sand from the trash, it is desirable to cause screen 42 of frame 28 to vibrate. The vibrations loosen the sand from itself and from the trash to thereby allow it to fall through the screen 42 and back onto the beach. A vibrator mechanism 50 is provided on upper support 44 and may impart an oscillatory vibration motion to frame 28. This may be accomplished simply by having a heavy cam rotate within vibrator 50 thereby imparting the vibration motion to frame 28. Because frame 28 is coupled to shovel 18 by shock absorber 46, the vibration motion imparted to frame 28 by vibrator 50 is for the most part isolated from shovel 18. Thus screen 42 moves independent of shovel 18.

After the area within frame 28 becomes full of trash by the operation of beach trash remover 10, shovel 18 may be moved upward so that the trash in shovel 18 can be placed on chute 16 and slide into container 14. Shovel 18 may then be lowered and the procedure of cleaning the beach continued as previously described.

What I claim is:

1. A machine for removing trash from a sandy beach comprising:

motorized means for moving along the beach and including a container;

shovel means attached to said motorized means for picking up trash and sand from said beach, said shovel means including attached screen means for separating said sand from said trash and returning said sand to the beach, said screen means being attached to said shovel means by means for permitting independent movement of said screen means with respect to said shovel means;

means for moving said screen means substantially independent of the movement of said shovel means for separating said sand and trash, said means for moving said screen means being mounted directly to and solely supported by said screen means; and means for transferring said trash remaining in said shovel means to said container.

2. The invention according to claim 1 wherein said shovel means includes an opening therein, and said screen means is affixed to said shovel means below and covering said opening.

3. The invention according to claim 2 wherein said means for permitting independent movement of said screen means comprises shock absorbing means.

4. The invention according to claim 3 wherein said screen means includes a frame covered by a mesh material sized to allow sand particles to easily pass therethrough and prevent trash material from passing therethrough, said frame being affixed to said shovel means by said shock absorbing means.

5. The invention according to claim 4 wherein said means for moving said screen means comprises a vibrator attached to said frame.

6. The invention according to claim 5 wherein said motorized means further includes tires and means for covering the tracks left by said tires as said motorized means moves along the beach.

7. The invention according to claim 6 wherein said shovel means further includes a pair of prongs, extendable therefrom, for engaging trash containers, and said means for transferring further moving said trash containers towards said motorizéd means for emptying the contents of said trash containers into said motorized means container.

8. The invention according to claim 1 wherein said motorized means further includes tires and means for covering the tracks left by said tires and said motorized means moves along the beach.

9. The invention according to claim 1 wherein said shovel means further includes a pair of prongs, extendable therefrom, for engaging trash containers, and said means for transferring further moving said trash containers towards said motorized means for emptying the contents of said trash containers into said motorized means container.

10. The invention according to claim 9 wherein said motorized means further includes tires and means for covering the tracks left by said tires as said motorized means moves along the beach.

11. The invention according to claim 1 wherein said means for permitting independent movement of said screen means comprises shock absorbing means.

12. The invention according to claim 1 wherein said means for moving said screen means comprises a vibrator.

13. The invention according to claim 12 wherein said means for permitting independent movement of said screen means comprises shock absorbing means.

* * * * *